US006517473B1

(12) United States Patent
Cappel

(10) Patent No.: US 6,517,473 B1
(45) Date of Patent: Feb. 11, 2003

(54) DEVICE AND METHOD FOR INSTALLING SLIDERS ON RECLOSABLE FASTENERS FOR PLASTIC BAGS

(75) Inventor: Craig E. Cappel, Pittsford, NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/951,060

(22) Filed: Sep. 13, 2001

(51) Int. Cl.[7] ..... B31B 1/84

(52) U.S. Cl. ..... 493/213; 493/212; 493/214; 493/232; 493/237; 53/139.2; 53/133.4; 53/412

(58) Field of Search ..... 493/212, 214, 493/232, 237, 213, 927; 53/139.2, 133.4, 412; 29/408, 409, 768; 83/917

(56) References Cited

U.S. PATENT DOCUMENTS

| | | | | |
|---|---|---|---|---|
| 3,426,396 A | 2/1969 | Laguerre | ..... | 24/201 |
| 3,701,191 A | 10/1972 | Laguerre | ..... | 29/207.5 SL |
| 3,701,192 A | 10/1972 | Laguerre | ..... | 29/207 |
| 4,581,006 A | 4/1986 | Hugues et al. | ..... | 493/213 |
| 5,431,760 A | 7/1995 | Donovan | ..... | 156/66 |
| 6,161,271 A | 12/2000 | Schreiter | ..... | 29/408 |

FOREIGN PATENT DOCUMENTS

| | | |
|---|---|---|
| GB | 2 085 519 A | 4/1982 |

*Primary Examiner*—John Sipos
*Assistant Examiner*—Brian Nash
(74) *Attorney, Agent, or Firm*—Jenkens & Gilchrist

(57) ABSTRACT

A device and method for installing sliders onto fasteners for plastic bags includes a rotor having one or more slider pockets for carrying sliders and one or more notch cutting tools for cutting notches in a fastener. A slider is put into a slider pocket and the rotor is actuated to cut a notch in a fastener and position a slider in the notch. The fastener is then advanced, sliding the slider onto the fastener.

15 Claims, 2 Drawing Sheets

DEVICE AND METHOD FOR INSTALLING SLIDERS ON RECLOSABLE FASTENERS FOR PLASTIC BAGS

FIELD OF THE INVENTION

The present invention relates generally to a device and method of installing sliders on reclosable fasteners of the type used on plastic bags.

BACKGROUND OF THE INVENTION

Plastic bags for storage of food and other products typically include a reclosable fastener on the mouth of the bag. One form of these bags includes a slider mounted on the reclosable fastener for opening and closing the fastener. Reclosable fasteners with a slider can be assembled separately from a bag or assembled on a bag. In either situation, the fastener is intermittently fed to a machine that stops the fastener to apply preseals at intervals in the fastener. The fastener is then fed or moved down line to locate each preseal adjacent to a notch cutting tool. The fastener is then stopped and a notch is cut in the fastener at the preseal by the cutting tool. The fastener is moved again to position the notch adjacent a slider installation mechanism. The fastener is stopped and a slider is positioned in the notch. The fastener is then restarted while the slider is briefly held in position. This movement of the fastener relative to the slider threads the slider onto the tracks of the fastener. The slider is then released and the fastener and slider are moved to storage, installation on a film or a bag, or if already on a bag, to a cutting station which forms individual bags with associated fasteners with sliders.

This procedure of installing a slider on a fastener requires several stations with each station having a separate, single function tool. Multiple tools at multiple locations is expensive. In addition, intermittent operation slows down the installation of sliders. Correct registration of the fastener and tool is also difficult. A less expensive and faster installation procedure would reduce costs and increase efficiencies.

SUMMARY OF THE INVENTION

The present invention is directed to a new device and method for installing sliders onto reclosable fasteners of the type applied to plastic bags. The device includes a rotor with one or more slider pockets for carrying a slider to a notch formed in a reclosable fastener. The rotor also includes one or more cutting tools which are part of the slider pockets or can be separate from the slider pockets.

To install sliders on a reclosable fastener, the fastener is drawn through a presealer that preseals the fastener at intervals. The fastener is then drawn to a position with a presealed area adjacent to the rotor. The rotor is actuated to engage a cutting tool with the fastener to cut out the presealed area. A slider pocket with a slider is then moved adjacent to the cut out presealed area and the fastener is then drawn down line to thread the slider onto the tracks of the fastener.

The device and method of this invention combines several of the devices of the prior art into one device. This reduces cost and the number of times the fastener must be stopped during the slider installation operation thus increasing the speed of the operation and reducing the likelihood of incorrect registration of the fastener with the tools.

BRIEF DESCRIPTION OF THE DRAWINGS

The foregoing and other advantages of the invention will become apparent upon reading the following detailed description and upon reference to the drawings.

Figure 1:
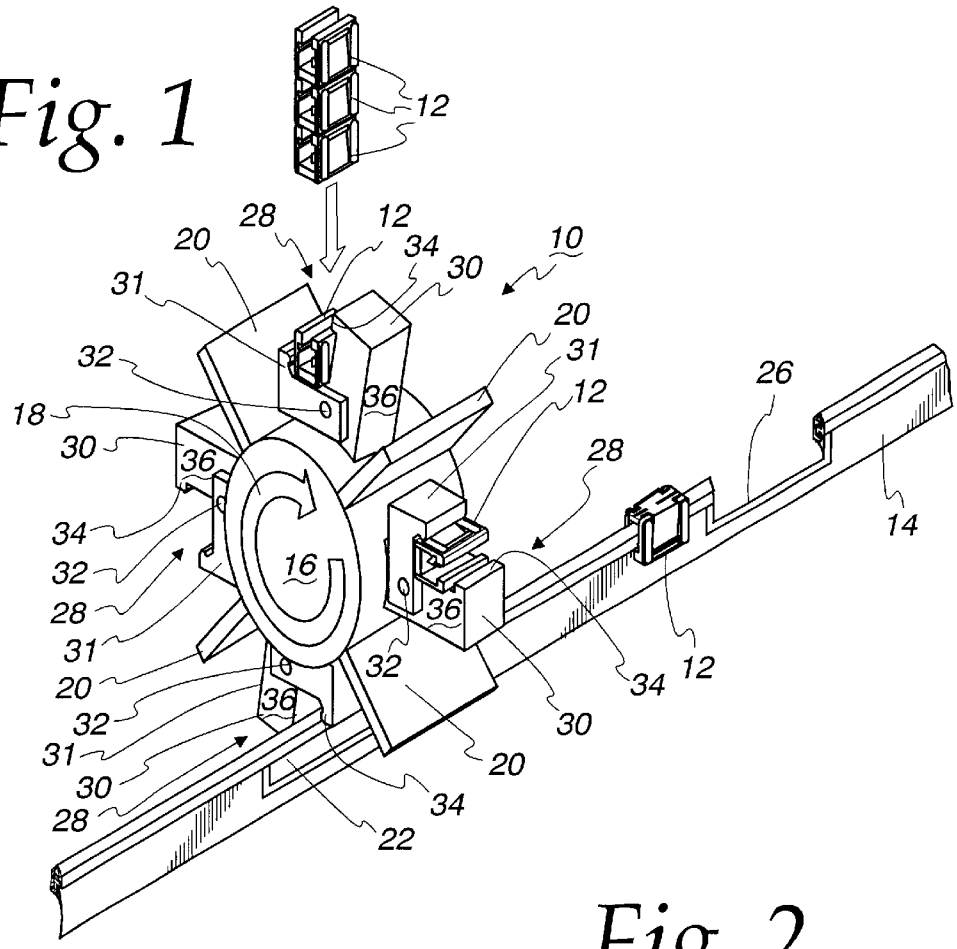
FIG. 1 is a perspective view of a slider installation device constructed in accordance with the principles of the present invention shown after the installation of a slider on a reclosable fastener.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Figure 2:
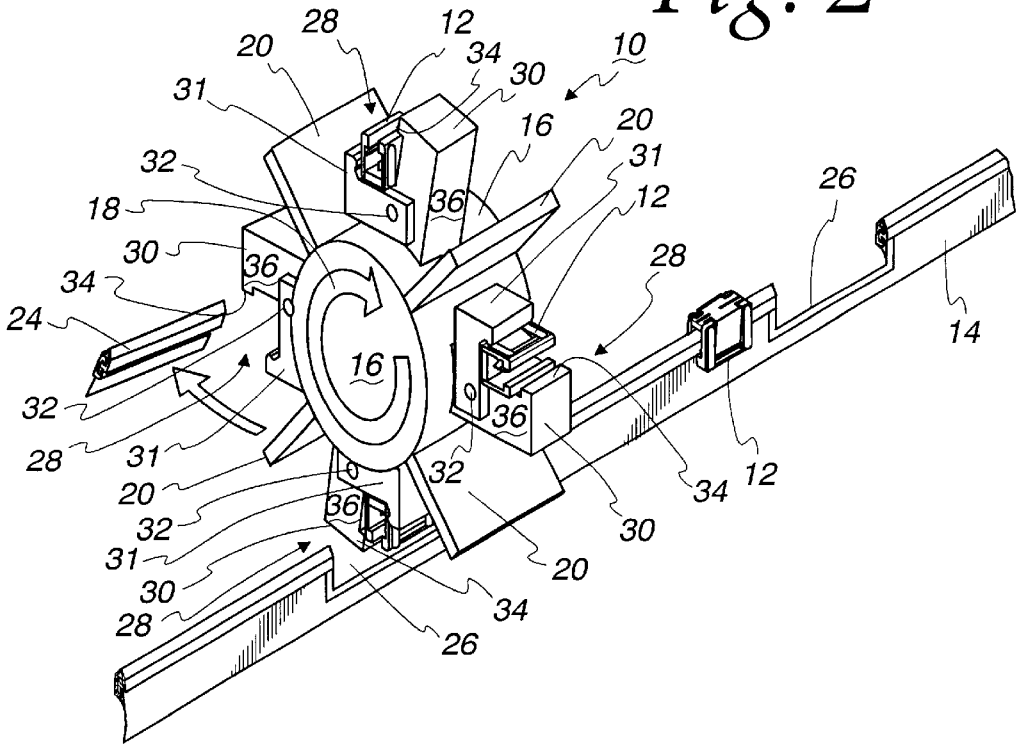
FIG. 2 is a view similar to FIG. 1 at the next step of cutting the reclosable fastener at a presealed area.

Referring initially to FIGS. 1 and 2, there is illustrated a slider installation assembly or device 10 for installing sliders 12 onto a reclosable fastener 14. The slider installation assembly 10 combines several prior art tools or machines and installation steps into one location to reduce variation, increase registration accuracy, and reduce overall size, complexity and space requirements.

Existing slider installation assemblies preseal the track flange of a reclosable fastener, notch the track profile of the fastener, and insert a slider onto the track profile each at individual stations spaced from each other. Each operation is performed one time during a dwell phase of indexing the fastener. These operations often result in a compromise in the registration of the fastener when indexed to subsequent stations. The slider installation assembly 10 of the present invention combines unit operations of the prior art into one unit. This simplifies the slider installation operation and eliminates variation in the registration of the fastener. The combination into one unit also reduces capital cost and space requirements.

The slider installation assembly 10 includes a rotor 16 that in the embodiment illustrated, is rotated in a clockwise direction as indicated by the arrow 18. A plurality of cutting or notch tools 20 are positioned at spaced locations on the periphery of the rotor 16. Each cutting tool 20 is dimensioned and located to engage a presealed area 22 of the fastener 14 and cut out a segment 24 of the track profile of the reclosable fastener 14 forming a notch 26 in the reclosable fastener 14.

A plurality of slider pockets 28 are also provided on the periphery of the rotor 16. Each slider pocket 28 is positioned between two cutting tools 20; however, the rotor 16 may include only a single cutting tool 20 and a single slider pocket 28. Each slider pocket 28 includes a vertical or side leg member 30 pivotally mounted on the rotor 16 by a pivot pin 32. Each vertical leg 30 is pivoted between a first, pocket closed position in which a slider 12 is held in the slider pocket 28 by a lip 34 on the vertical leg 30 and a second, pocket open position for loading and installing sliders 12. Each slider pocket 28 also includes a horizontal or bottom leg 31 that is rigidly secured to the rotor 16 and supports a slider 12 placed in the slider pocket 28. The slider pockets 28 in the twelve, six and nine o'clock positions in FIGS. 1 and 2 are in the second pocket open position and the slider pocket 28 in the three o'clock position in FIGS. 1 and 2 is in the first, pocket closed position. Each vertical leg 30 is pivoted by a spring or pneumatic actuator 36.

The slider installation operation begins by indexing the reclosable fastener 14 to position a presealed area 22 adjacent the slider installation assembly 10. A slider 12 is placed into an open slider pocket 28 (FIG. 1), the slider pocket is closed, and the rotor 16 is rotated. As the rotor is rotated, a cutting tool 20 engages the track portion of the reclosable fastener 14 at the presealed area 22 cutting out a segment of the track profile 24 to form a notch 26 in the presealed area 22 of the fastener 14 (FIG. 2). The rotor 16 continues to rotate to position a slider pocket 28 in the notch 26. In this position, the actuator 36 is actuated to open the slider pocket 28 and place a slider 12 in the notch 26. The fastener is then indexed to thread the slider 12 onto the track profile of the reclosable fastener 14. This cycle is then repeated.

Figure 3:
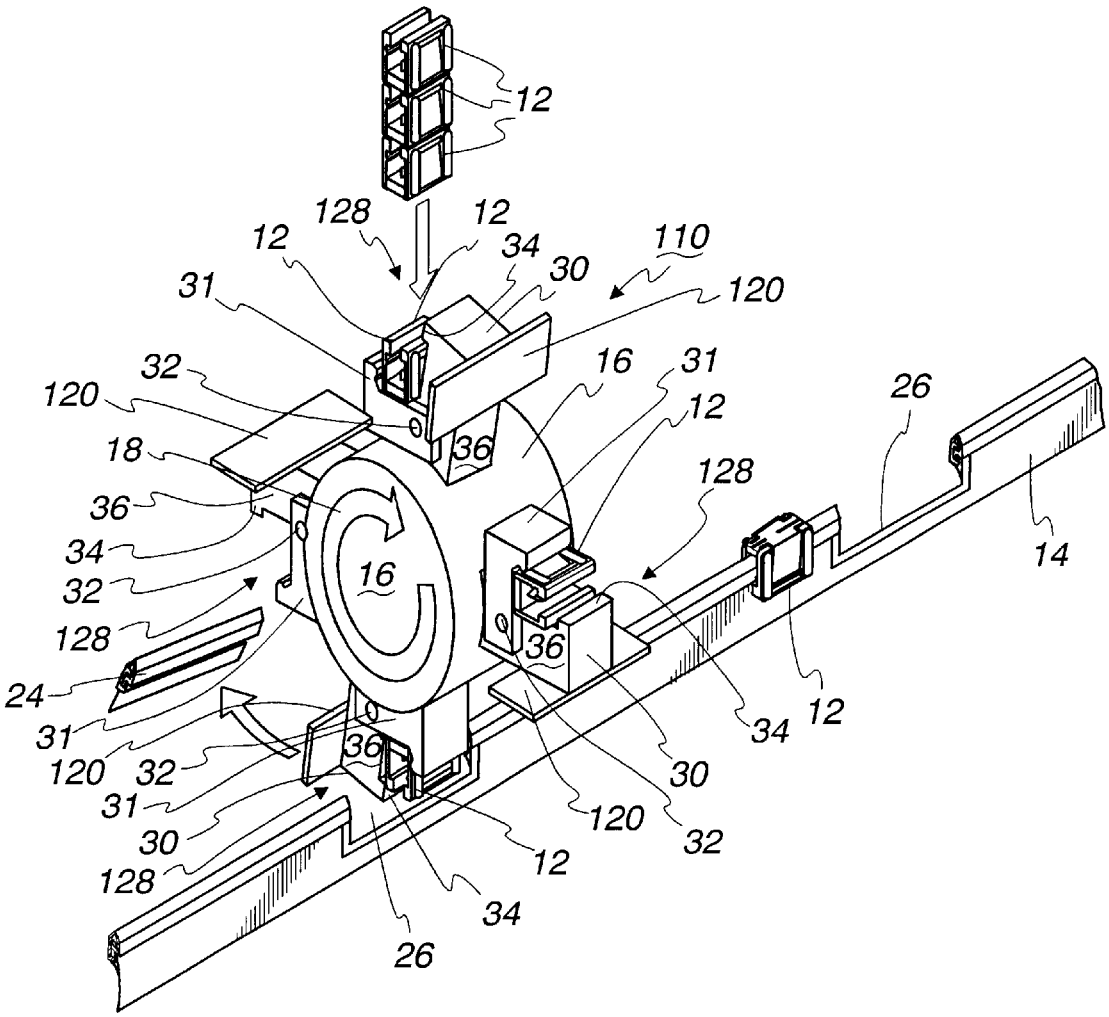
FIG. 3 is a view similar to FIG. 2 illustrating an alternative embodiment of a slider installation device.

An alternative embodiment 110 of the slider installation assembly is illustrated in FIG. 3. Components of the slider installation assemblies 10, 110 that are the same bear the same reference numeral. The slider installation assembly 110 of FIG. 3 includes a cutting tool 120 attached to the vertical or side leg 30 of each slider pocket 128. This reduces the space on the rotor 16 taken up by the cutting tools 120 and slider pockets 128 allowing more tools to be placed on the periphery of the rotor 16 if desired.

The operation of the slider installation assembly 110 of FIG. 3 is substantially the same as the operation of the slider installation assembly 10 of FIGS. 1 and 2. Specifically, the reclosable fastener 14 is indexed to position a presealed area adjacent the slider installation assembly 110. A slider 12 is placed into an open slider pocket 128 (at the twelve o'clock position in FIG. 3), the slider pocket 128 is closed, and the rotor 16 is rotated in the direction of arrow 18. This rotation engages a cutting tool 120 with a presealed area of the fastener 14 to cut out a segment of the track profile 24 forming a notch 26. The slider pocket 128 associated with the cutting tool 120 is opened and the slider carried in the slider pocket 128 is located in the notch 26. The fastener 14 is then indexed to thread the slider 12 onto the track profile.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A device for positioning sliders on a reclosable fastener, comprising:

a rotor;

a first notch cutting tool mounted on said rotor at a location to engage and cut a notch in a reclosable fastener upon rotation of said rotor; and a first slider pocket mounted on said rotor adjacent said first notch cutting tool to place a slider in a notch cut in said reclosable fastener by said first notch cutting tool, wherein said first slider pocket includes a base secured to said rotor and a wall member pivotally mounted to said base.

2. The device claimed in claim 1 comprising a plurality of said first notch cutting tools and a plurality of said first slider pockets.

3. The device claimed in claim 1 wherein said first notch cutting tool is on said first slider pocket.

4. The device claimed in claim 1 wherein said first slider pocket includes a base secured to said rotor, a wall member pivotally mounted to said base, and an actuator for pivoting said wall member to a first position for loading and unloading a slider and to a second position for holding a slider.

5. A method of installing sliders onto a reclosable fastener, comprising:

providing a rotor with at least one slider pocket mounted on said rotor and at least one notch cutter mounted on said rotor, providing a supply of sliders;

providing a reclosable fastener;

indexing said rotor to a first position;

loading a slider in said slider pocket;

cutting a notch with said notch cutter in said reclosable fastener;

indexing said rotor to a second position to locate said slider pocket adjacent said notch in said reclosable zipper; and installing said slider on said reclosable fastener.

6. The method of installing sliders claimed in claim 5, further comprising forming a preseal in said reclosable fastener, and cutting said notch in said preseal.

7. The method of installing sliders claimed in claim 5 further comprising actuating said slider pocket to an open position while loading said slider, and actuating said slider to an installing position while installing said slider.

8. The method of installing sliders claimed in claim 5 further comprising a plurality of slider pockets on said rotor.

9. A method of installing a slider onto a reclosable fastener, comprising:

providing a reclosable fastener with a preseal, providing a rotary slider installation device, providing a plurality of slider pockets on said rotary slider installation device;

providing a supply of sliders;

providing a plurality of notch cutters on said rotary slider installation device with a notch cutter between adjacent slider pockets;

indexing said reclosable fastener to position said preseal adjacent said rotary slider installation device;

indexing said rotary slider installation device to position a first slider pocket adjacent said supply of sliders;

loading a slider in said first slider pocket;

indexing said rotary slider installation device to engage one of said notch cutters with said preseal and to cut a notch in said reclosable fastener;

indexing said rotary slider device to position said first slider pocket with a loaded slider adjacent said notch in said reclosable fastener; and actuating said first slider pocket with said loaded slider to install said loaded slider in said notch.

10. The method of installing a slider claimed in claim 9 further comprising indexing said reclosable fastener after installing said loaded slider in said notch.

11. The method of installing a slider claimed in claim 9 further comprising loading a slider in a second slider pocket while actuating said first slider pocket to install said loaded slider in said notch.

12. A device for postponing sliders on a reclosable fastener, comprising:

a rotor;

a first notch cutting tool mounted on said rotor at a location to engage and cut a notch in a reclosable fastener upon rotation of said rotor; and a first slider pocket mounted on said rotor adjacent said first notch cutting tool to place a slider in a notch cut in said reclosable fastener by said first notch cutting tool, wherein said first slider pocket includes a base secured to said rotor, a wall member pivotally mounted to said base, and an actuator for pivoting said wall member to a first position for loading and unloading a slider and to a second position for holding a slider.

13. The device claimed in claim 12 comprising a plurality of said first notch cutting tools and a plurality of said first slider pockets.

14. The device claimed in claim 12 wherein said first notch cutting tool is on said first slider pocket.

15. The device claimed in claim 12 wherein said first slider pocket includes a base secured to said rotor and a wall member pivotally mounted to said base.

* * * * *

UNITED STATES PATENT AND TRADEMARK OFFICE

CERTIFICATE OF CORRECTION

PATENT NO. : 6,517,473 B1
DATED : February 11, 2003
INVENTOR(S) : Cappel

It is certified that error appears in the above-identified patent and that said Letters Patent is hereby corrected as shown below:

Title page,
Item [56], U.S. PATENT DOCUMENTS, insert the following references:

| | | | |
|---|---|---|---|
| -- 3,790,992 | 2/1974 | Herz | 156/251 |
| 3,910,811 | 10/1975 | Paxton et al. | 156/521 |
| 4,115,000 | 9/1978 | Mischo et al. | 234/130 |
| 5,617,770 | 4/1997 | May | 29/410 |
| 5,776,045 | 7/1998 | Bodolay et al. | 156/519 |
| 5,956,924 | 9/1999 | Thieman | 53/133.4 |
| 5,983,599 | 11/1999 | Krueger | 493/213 |
| 6,003,582 | 12/1999 | Blohowiak et al. | 156/567 |
| 6,021,621 | 2/2000 | Linkiewicz | 493/196 |
| 6,095,369 | 8/2000 | Jenkins et al. | 221/253 |
| 6,098,369 | 8/2000 | Bodolay et al. | 493/213 |
| 6,286,189 | 9/2001 | Provan et al. | 24/30.5R |
| 6,292,986 | 9/2001 | Provan et al. | 24/383 |
| 6,293,896 | 9/2001 | Buchman | 493/213 -- |

Signed and Sealed this

Fifth Day of August, 2003

JAMES E. ROGAN
*Director of the United States Patent and Trademark Office*